US011519623B2

(12) United States Patent
Ebina et al.

(10) Patent No.: US 11,519,623 B2
(45) Date of Patent: Dec. 6, 2022

(54) AIR-CONDITIONING APPARATUS

(71) Applicant: DAIKIN INDUSTRIES, LTD., Osaka (JP)

(72) Inventors: Hiroshi Ebina, Osaka (JP); Takashi Hasegawa, Osaka (JP); Toshimichi Nakayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 63 days.

(21) Appl. No.: 16/925,769

(22) Filed: Jul. 10, 2020

(65) Prior Publication Data

US 2020/0340699 A1 Oct. 29, 2020

Related U.S. Application Data

(63) Continuation of application No. PCT/JP2019/003693, filed on Feb. 1, 2019.

(30) Foreign Application Priority Data

Feb. 19, 2018 (JP) ..... JP2018-026692
Feb. 19, 2018 (JP) ..... JP2018-026693

(51) Int. Cl.
*F24F 11/41* (2018.01)
*F24F 11/65* (2018.01)
(Continued)

(52) U.S. Cl.
CPC ..... *F24F 11/41* (2018.01); *F24F 1/0059* (2013.01); *F24F 3/06* (2013.01); *F24F 5/0089* (2013.01);
(Continued)

(58) Field of Classification Search
CPC .. F24F 11/41; F24F 11/42; F24F 11/65; F24F 11/89; F24F 1/0059; F24F 5/0089
See application file for complete search history.

(56) References Cited

U.S. PATENT DOCUMENTS 5,267,450 A * 12/1993 Takegawa ..... F24F 5/0089 62/176.2
5,542,260 A * 8/1996 Bourne ..... F24F 5/0017 62/171
(Continued)

FOREIGN PATENT DOCUMENTS

CN 103328895 A 9/2013
CN 104180563 A 12/2014
(Continued)

OTHER PUBLICATIONS

International Search Report issued in International Application No. PCT/JP2019/003693, dated Apr. 9, 2019 (3 pages).
(Continued)

*Primary Examiner* — Nelson J Nieves
(74) *Attorney, Agent, or Firm* — Osha Bergman Watanabe & Burton LLP

(57) ABSTRACT

An air conditioner switches between a normal refrigeration cycle and a defrosting refrigeration cycle, and includes: a refrigerant circuit that connects a first heat exchanger, a second heat exchanger, a radiation panel, and an expansion valve that regulates a flow rate of a refrigerant flowing through the radiation panel; and a controller that causes the air conditioner to switch between the normal refrigeration cycle and the defrosting cycle. During the normal refrigeration cycle, the radiation panel performs cooling or heating. During the defrosting cycle, the first heat exchanger serves as a radiator and the second heat exchanger serves as an evaporator. During the defrosting cycle, the controller causes the expansion valve to be in a fully closed state.

11 Claims, 8 Drawing Sheets

(51) Int. Cl.

| | |
|---|---|
| ***F24F 11/89*** | (2018.01) |
| ***F24F 1/0059*** | (2019.01) |
| ***F24F 3/06*** | (2006.01) |
| ***F24F 5/00*** | (2006.01) |
| ***F24F 13/30*** | (2006.01) |
| ***F24F 7/00*** | (2021.01) |

(52) U.S. Cl.

CPC ..... *F24F 11/65* (2018.01); *F24F 11/89* (2018.01); *F24F 13/30* (2013.01); *F24F 2007/004* (2013.01)

(56) References Cited

U.S. PATENT DOCUMENTS

| | | | | |
|---|---|---|---|---|
| 5,675,976 | A * | 10/1997 | Tobi | F24F 11/30 62/180 |
| 2012/0000224 | A1* | 1/2012 | Kizawa | F24F 5/0089 62/132 |
| 2015/0121913 | A1* | 5/2015 | Kato | F25B 49/02 62/81 |
| 2015/0338108 | A1 | 11/2015 | Murakami | |
| 2016/0047577 | A1* | 2/2016 | Murakami | F25B 13/00 62/498 |
| 2016/0123635 | A1 | 5/2016 | Huang et al. | |
| 2016/0273816 | A1* | 9/2016 | Horiuchi | F25B 13/00 |
| 2018/0087787 | A1* | 3/2018 | Murakami | F24F 5/0089 |
| 2020/0049392 | A1* | 2/2020 | Tanaka | F25B 47/025 |

FOREIGN PATENT DOCUMENTS

| | | | |
|---|---|---|---|
| EP | 2309199 | A1 | 4/2011 |
| EP | 2667108 | A1 | 11/2013 |
| EP | 2863153 | A1 | 4/2015 |
| EP | 3040635 | A1 | 7/2016 |
| EP | 3054230 | A1 | 8/2016 |
| JP | H8-226716 | A | 9/1996 |
| JP | 2012-149837 | A | 8/2012 |
| JP | 2015-25627 | A | 2/2015 |

OTHER PUBLICATIONS

Written Opinion issued in International Application No. PCT/JP2019/003693, dated Apr. 9, 2019 (4 pages).

International Preliminary Report on Patentability issued for PCT/JP2019/003693, dated Aug. 27, 2020 (7 pages).

Extended European Search Report issued in corresponding European Patent Application No. 19754417.4, dated Feb. 25, 2021 (7 pages).

* cited by examiner

AIR-CONDITIONING APPARATUS

CROSS-REFERENCE TO RELATED APPLICATIONS

This is a continuation of International Application No. PCT/JP2019/3693 filed on Feb. 1, 2019, which claims priority to Japanese Patent Application Nos. 2018-026692 and 2018-026693 both filed on Feb. 19, 2018. The entire disclosures of these applications are incorporated herein by reference.

BACKGROUND

Technical Field

The present invention relates to an air conditioner.

Description of the Related Art

Patent Document 1 discloses an air conditioner including a radiant indoor unit and a convection indoor unit. The radiant indoor unit and the convection indoor unit are connected to a refrigerant circuit. For example, in a heating operation, a refrigerant dissipates heat and is condensed in a heating element of the radiant indoor unit, and dissipates heat and is condensed in the convection indoor unit, in parallel.

PATENT DOCUMENT

Patent Document 1: Japanese Unexamined Patent Publication No. 2015-25627

SUMMARY

An air conditioner according to one or more embodiments includes a refrigerant circuit (11) connecting a first heat exchanger (22), a second heat exchanger (31), a radiation panel (40), and an expansion valve (51) that regulates a flow rate of a refrigerant flowing through the radiation panel (40); and a control unit (C1) that switches between a normal refrigeration cycle in which the radiation panel (40) performs cooling or heating, and a defrosting cycle in which the first heat exchanger (22) serves as a radiator and the second heat exchanger (31) serves as an evaporator, wherein the control unit (C1) brings the expansion valve (51) to be fully closed during the defrosting cycle.

According to one or more embodiments, the refrigerant can be kept from flowing inside the radiation panel (40) during the defrosting cycle. This makes it possible to defrost a surface of the first heat exchanger (22), while avoiding the radiation panel (40) from serving as an evaporator.

DETAILED DESCRIPTION

An air conditioner (10) of one or more embodiments will be described with reference to the drawings.

<General Configuration>

Figure 1:
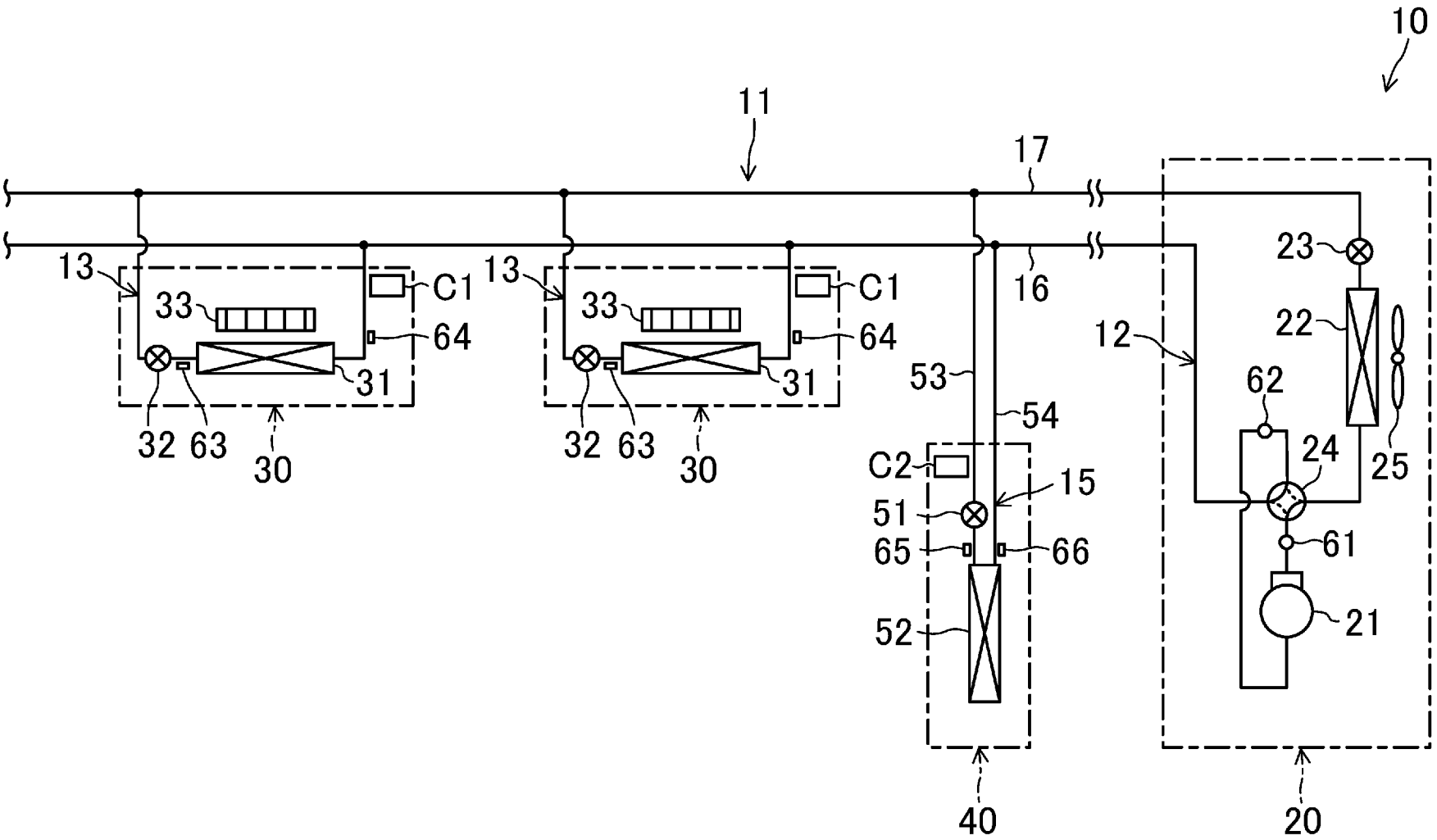
FIG. 1 is a piping system diagram illustrating a schematic configuration of an air conditioner according to one or more embodiments.

The air conditioner (10) performs switching between cooling and heating of a room. As shown in FIG. 1, the air conditioner (10) includes an outdoor unit (20), an indoor unit (30), and a radiation panel (40).

The outdoor unit (20) is placed outside. The outdoor unit (20) constitutes a heat source unit. The outdoor unit (20) is provided with a compressor (21), an outdoor heat exchanger (22), an outdoor expansion valve (23), a four-way switching valve (24), and an outdoor fan (25).

The indoor unit (30) is provided near a ceiling of the room. The indoor unit (30) constitutes a convection indoor unit that performs cooling or heating with the air transported by an indoor fan (33). The indoor unit (30) includes a single indoor unit, or two or more indoor units. Each indoor unit (30) is provided with an indoor heat exchanger (31), an indoor expansion valve (32), and an indoor fan (33).

The radiation panel (40) is placed on a floor surface of the room. The radiation panel (40) constitutes a radiant indoor unit that performs cooling or heating by the transfer of radiant heat. The radiation panel (40) includes a single radiation panel, or two or more radiation panels.

The air conditioner (10) includes a refrigerant circuit (11) which is filled with a refrigerant and allows the refrigerant to circulate therein. The refrigerant circuit (11) will be described in detail later.

<General Configuration of Radiation Panel>

Figure 2:
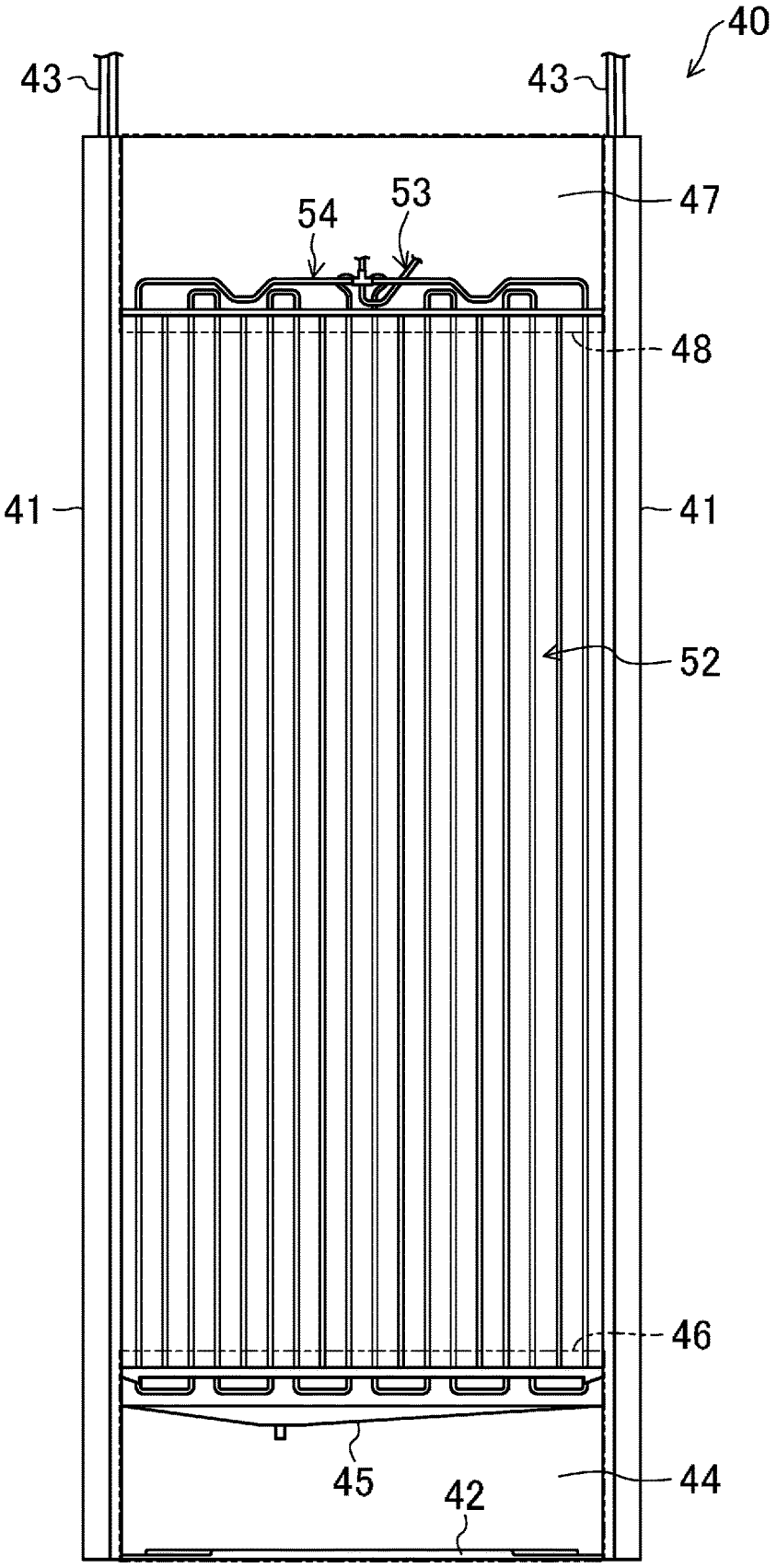
FIG. 2 is a front view illustrating a schematic configuration of a radiation panel according to one or more embodiments.

A general configuration of the radiation panel (40) will be described with reference to FIG. 2. The radiation panel (40) includes a pair of supports (41), a panel body (52) (also referred to as a "radiation heat exchanger (52)"), and a bottom plate (42).

The supports (41) are provided at the left and right ends of the radiation panel (40), respectively. Each support (41) stands upright on the floor surface to extend vertically.

The panel body (52) is provided between the pair of supports (41). The panel body (52) has its front face and rear face exposed to an indoor space.

The bottom plate (42) extends laterally between the pair of supports (41) to be coupled to lower ends of the pair of supports (41). The bottom plate (42) is fixed to the floor surface of the room with fastening members (not shown), such as anchor bolts. Upper ends of the pair of supports (41) are connected to hanging bolts (not shown) on the ceiling via fixing portions (43).

The radiation panel (40) forms a lower housing chamber (44) below the panel body (52). A drain pan (45) that collects condensation water generated on the panel body (52) is provided in the lower housing chamber (44). A front open face and rear open face of the lower housing chamber (44) are covered with lower covers (46), respectively. The lower covers (46) are detachably attached to, for example, lower portions of the pair of supports (41).

The radiation panel (40) forms an upper housing chamber (47) above the panel body (52). The upper housing chamber (47) houses a liquid pipe (53) and gas pipe (54) of a refrigerant pipe. A radiation expansion valve (51) (not shown in FIG. 2) is connected to the liquid pipe (53). A front open face and rear open face of the upper housing chamber (47) are covered with upper covers (48), respectively. The upper covers (48) are detachably attached to, for example, upper portions of the pair of supports (41).

<Detailed Configuration of Refrigerant Circuit>

The configuration of the refrigerant circuit (11) will be described in more detail with reference to FIG. 1. The refrigerant circuit (11) includes an outdoor circuit (12), an indoor circuit (13), and a radiation circuit (15). The outdoor circuit (12) is provided in the outdoor unit (20), the indoor circuit (13) in the indoor unit (30), and the radiation circuit (15) in the radiation panel (40). In one or more embodiments, the indoor unit (30) and the radiation panel (40) are connected to the outdoor unit (20) via two connection pipes (16, 17). Strictly speaking, the indoor circuit (13) and the radiation circuit (15) are connected to the outdoor circuit (12) via a gas connection pipe (16) and a liquid connection pipe (17) which are the connection pipes.

<Outdoor Circuit>

The outdoor circuit (12) connects the compressor (21), the outdoor heat exchanger (22) (first heat exchanger), the outdoor expansion valve (23), and the four-way switching valve (24). The compressor (21) is configured as a variable capacity compressor. More specifically, an inverter device controls an operation frequency (number of rotations) of the compressor (21), so that the amount of the refrigerant circulating in the refrigerant circuit (11) can be adjusted. The outdoor fan (25) that transfers the outdoor air is provided near the outdoor heat exchanger (22). The outdoor heat exchanger (22) allows the refrigerant flowing therein to exchange heat with the outdoor air transferred by the outdoor fan (25). The outdoor expansion valve (23) is a flow rate control valve having a variable opening degree, and is constituted of, for example, an electronic expansion valve.

The four-way switching valve (24) serves as a switching mechanism for switching between a heating operation and a cooling operation. Specifically, the four-way switching valve (24) is configured to be switchable between a first state (a state indicated by a solid line in FIG. 1) and a second state (a state indicated by a broken line in FIG. 1). The four-way switching valve (24) is switched to the first state in the cooling operation and a defrosting operation (will be described in detail later). The four-way switching valve (24) in the first state causes a discharge side of the compressor (21) and a gas end portion of the outdoor heat exchanger (22) to communicate with each other, and suction side of the compressor (21) and the gas connection pipe (16) to communicate with each other, in parallel. The four-way switching valve (24) is switched to the second state in the heating operation. The four-way switching valve (24) in the second state causes the discharge side of the compressor (21) and the gas connection pipe (16) to communicate with each other, the suction side of the compressor (21) and the gas end portion of the outdoor heat exchanger (22) to communicate with each other, in parallel.

The outdoor circuit (12) is provided with a discharge pressure sensor (61) and a suction pressure sensor (62). The discharge pressure sensor (61) is arranged on the discharge side of the compressor (21). The discharge pressure sensor (61) detects the pressure of the refrigerant discharged from the compressor (21) (high pressure of the refrigerant circuit (11)). The suction pressure sensor (62) detects the pressure of the refrigerant to be sucked into the compressor (21) (low pressure of the refrigerant circuit (11)).

<Indoor Circuit>

The number of indoor circuits (13) corresponds to the number of indoor units (30). One end (liquid end portion) of the indoor circuit (13) is connected to the liquid connection pipe (17). The other end (gas end portion) of the indoor circuit (13) is connected to the gas connection pipe (16). In the indoor circuit (13), the indoor expansion valve (32) and the indoor heat exchanger (31) (second heat exchanger) are connected in this order from the liquid end portion to gas end portion of the indoor circuit (13). The indoor expansion valve (32) is a flow rate control valve (first control valve) whose opening degree is variable, and is constituted of an electronic expansion valve, for example. The indoor fan (33) that transfers the indoor air is provided near the indoor heat exchanger (31). The indoor heat exchanger (31) allows the refrigerant flowing therein to exchange heat with the indoor air transferred by the indoor fan (33).

The indoor circuit (13) is provided with a first liquid-side temperature sensor (63) and a first gas-side temperature sensor (64). The first liquid-side temperature sensor (63) is provided on a liquid side of the indoor heat exchanger (31), and detects the temperature of a liquid refrigerant flowing through the indoor circuit (13). The first gas-side temperature sensor (64) is provided on a gas side of the indoor heat exchanger (31), and detects the temperature of a gas refrigerant flowing through the indoor circuit (13).

<Radiation Circuit>

The number of radiation circuits (15) corresponds to the number of radiation panels (40). One end (liquid end portion) of the radiation circuit (15) is connected to the liquid connection pipe (17). The other end (gas end portion) of the radiation circuit (15) is connected to the gas connection pipe (16). In the radiation circuit (15), the radiation expansion valve (51) and the radiation heat exchanger (52) are connected in this order from the liquid end portion to the gas end portion of the radiation circuit (15). The radiation expansion valve (51) is a flow rate control valve (second control valve) whose opening degree is variable, and is constituted of an electronic expansion valve, for example. No fan that transfers the air is provided near the radiation heat exchanger (52). That is, the radiation heat exchanger (52) exchanges heat between the refrigerant and the indoor air through the transfer of radiant heat.

The radiation circuit (15) is provided with a second liquid-side temperature sensor (65) and a second gas-side temperature sensor (66). The second liquid-side temperature sensor (65) is provided on the liquid side (liquid pipe (53)) of the radiation heat exchanger (52), and detects the temperature of a liquid refrigerant flowing through the radiation circuit (15). The second gas-side temperature sensor (66) is provided on the gas side (gas pipe (54)) of the radiation heat exchanger (52), and detects the temperature of a gas refrigerant flowing through the radiation circuit (15).

<Indoor Controller and Radiation Controller>

As shown in FIG. 1, the indoor unit (30) of one or more embodiments is provided with an indoor controller (C1), and the radiation panel (40) with a radiation controller (C2) (individually or collectively referred to herein as "control unit" or "controller"). Each of the indoor controller (C1) and the radiation controller (C2) includes a microcomputer, and a memory device (specifically, a semiconductor memory) that stores software for operating the microcomputer. The indoor controller (C1) and the radiation controller (C2) can receive detection signals from various sensors, and can output control signals.

The indoor controller (C1) controls start and stop (so-called thermo-on and thermo-off) of the indoor unit (30). More specifically, when a temperature Tr of the indoor air reaches a predetermined value according to a set temperature Ts, the indoor controller (C1) stops the indoor unit (30) (thermo-off).

In the cooling operation, the indoor controller (C1) performs so-called superheat degree control on the opening degree of the indoor expansion valve (32). Specifically, in the cooling operation, the opening degree of the indoor expansion valve (32) is regulated so that a degree of superheat SH1 of the refrigerant that has evaporated in the indoor heat exchanger (31) approaches a target degree of superheat. Here, the degree of superheat SH1 is obtained, for example, from a difference between the temperature of the refrigerant detected by the first gas-side temperature sensor (64) and a saturation temperature corresponding to the low pressure detected by the suction pressure sensor (62).

In the heating operation, the indoor controller (C1) performs so-called subcooling degree control on the opening degree of the indoor expansion valve (32). Specifically, in the heating operation, the opening degree of the indoor expansion valve (32) is regulated so that a degree of subcooling SC1 of the refrigerant that has been condensed in the indoor heat exchanger (31) approaches a target degree of subcooling. Here, the degree of subcooling SC1 is obtained, for example, from a difference between the temperature of the refrigerant detected by the first liquid-side temperature sensor (63) and a saturation temperature corresponding to the high pressure detected by the discharge pressure sensor (61).

In the defrosting operation, the indoor controller (C1) causes the indoor expansion valve (32) to open at a predetermined opening degree. The opening degree of the indoor expansion valve (32) at this time may be a predetermined fixed opening degree, or may suitably be regulated through the superheat degree control, for example. Accordingly, in the defrosting operation, the indoor heat exchanger (31) functions as an evaporator.

In the cooling operation, the radiation controller (C2) performs so-called superheat degree control on the opening degree of the radiation expansion valve (51). Specifically, in the heating operation, the opening degree of the radiation expansion valve (51) is regulated so that a degree of superheat SH2 of the refrigerant that has evaporated in the radiation heat exchanger (52) approaches a target degree of superheat. Here, the degree of superheat SH2 is obtained, for example, from a difference between the temperature of the refrigerant detected by the second gas-side temperature sensor (66) and the saturation temperature corresponding to the low pressure detected by the suction pressure sensor (62).

In the heating operation, the radiation controller (C2) performs so-called subcooling degree control on the opening degree of the radiation expansion valve (51). Specifically, in the heating operation, the opening degree of the radiation expansion valve (51) is regulated so that a degree of subcooling SC2 of the refrigerant that has been condensed in the radiation heat exchanger (52) approaches a target degree of subcooling. Here, the degree of subcooling SC2 is obtained, for example, from a difference between the temperature of the refrigerant detected by the second liquid-side temperature sensor (65) and the saturation temperature corresponding to the high pressure detected by the discharge pressure sensor (61).

The radiation controller (C2) controls the opening degree of the radiation expansion valve (51) in the defrosting operation and a preparatory operation performed immediately before the defrosting operation. Specifically, the radiation controller (C2) controls the radiation expansion valve (51) such that the radiation expansion valve (51) is always fully closed in the defrosting operation. In the preparatory operation, the radiation controller (C2) causes the radiation expansion valve (51) to open at a predetermined opening degree (will be described in detail later).

Operation

An operation of the air conditioner (10) according to one or more embodiments will be described with reference to FIG. 1. The air conditioner (10) performs operation while switching between the cooling operation and the heating operation.

<Cooling Operation>

In the cooling operation, the compressor (21), the outdoor fan (25), and the indoor fan (33) are operated. The four-way switching valve (24) is brought into the first state. The outdoor expansion valve (23) is opened at a predetermined opening degree (e.g., fully opened). The superheat degree control is performed on the opening degrees of the indoor expansion valve (32) and the radiation expansion valve (51). In the cooling operation, a refrigeration cycle is performed, in which the refrigerant that has been condensed and has dissipated heat in the outdoor heat exchanger (22) evaporates in the indoor heat exchanger (31) and the radiation heat exchanger (52) (i.e., the radiation panel (40)).

Specifically, the refrigerant compressed in the compressor (21) flows through the outdoor heat exchanger (22). In the outdoor heat exchanger (22), the refrigerant dissipates heat to the outdoor air to be condensed. The refrigerant that has been condensed in the outdoor heat exchanger (22) passes through the outdoor expansion valve (23), and then flows through the liquid connection pipe (17). The refrigerant flowing through the liquid connection pipe (17) diverges into the indoor circuit (13) and the radiation circuit (15).

The refrigerant that has flowed into the indoor circuit (13) is decompressed by the indoor expansion valve (32), and then flows through the indoor heat exchanger (31). In the indoor heat exchanger (31), the refrigerant absorbs heat from the air transported by the indoor fan (33) to evaporate. The refrigerant evaporated in the indoor heat exchanger (31) flows into the gas connection pipe (16).

The refrigerant that has flowed into the radiation circuit (15) is decompressed by the radiation expansion valve (51), and then flows through the radiation heat exchanger (52). In the radiation heat exchanger (52), the refrigerant absorbs heat from the indoor air around the radiation panel (40) to evaporate. The refrigerant evaporated in the radiation heat exchanger (52) flows into the gas connection pipe (16).

The flows of the refrigerant merge together in the gas connection pipe (16), which is then sucked into the compressor (21) and compressed again.

<Heating Operation>

In the heating operation, the compressor (21), the outdoor fan (25), and the indoor fan (33) are operated. The four-way switching valve (24) is brought into the second state. The superheat degree control is performed on the outdoor expansion valve (23). The subcooling degree control is performed on the opening degrees of the indoor expansion valve (32) and the radiation expansion valve (51). In the heating operation, a refrigeration cycle is performed, in which the refrigerant that has been condensed and has dissipated heat in the indoor heat exchanger (31) and the radiation heat exchanger (52) evaporates in the outdoor heat exchanger (22).

Specifically, the refrigerant compressed in the compressor (21) flows through the gas connection pipe (16), and diverges into the outdoor circuit (12) and the radiation circuit (15).

The refrigerant that has flowed into the indoor circuit (13) flows through the indoor heat exchanger (31). In the indoor heat exchanger (31), the refrigerant dissipates heat into the air transported by the indoor fan (33) to be condensed. The refrigerant that has been condensed in the indoor heat exchanger (31) passes through the indoor expansion valve (32), and then flows into the liquid connection pipe (17).

The refrigerant that has flowed into the radiation circuit (15) flows through the radiation heat exchanger (52). In the radiation heat exchanger (52), the refrigerant dissipates heat into the indoor air around the radiation panel (40) to be condensed. The refrigerant condensed in the radiation heat exchanger (52) passes through the radiation expansion valve (51), and then flows into the liquid connection pipe (17).

The flows of the refrigerant merge together in the liquid connection pipe (17), which flows into the outdoor circuit (12), is decompressed by the outdoor expansion valve (23), and then flows through the outdoor heat exchanger (22). In the outdoor heat exchanger (22), the refrigerant absorbs heat from the outdoor air to evaporate. The refrigerant evaporated in the outdoor heat exchanger (22) is sucked into the compressor (21), and is compressed again.

Overview of Preparatory Operation and Defrosting Operation

Figure 3:
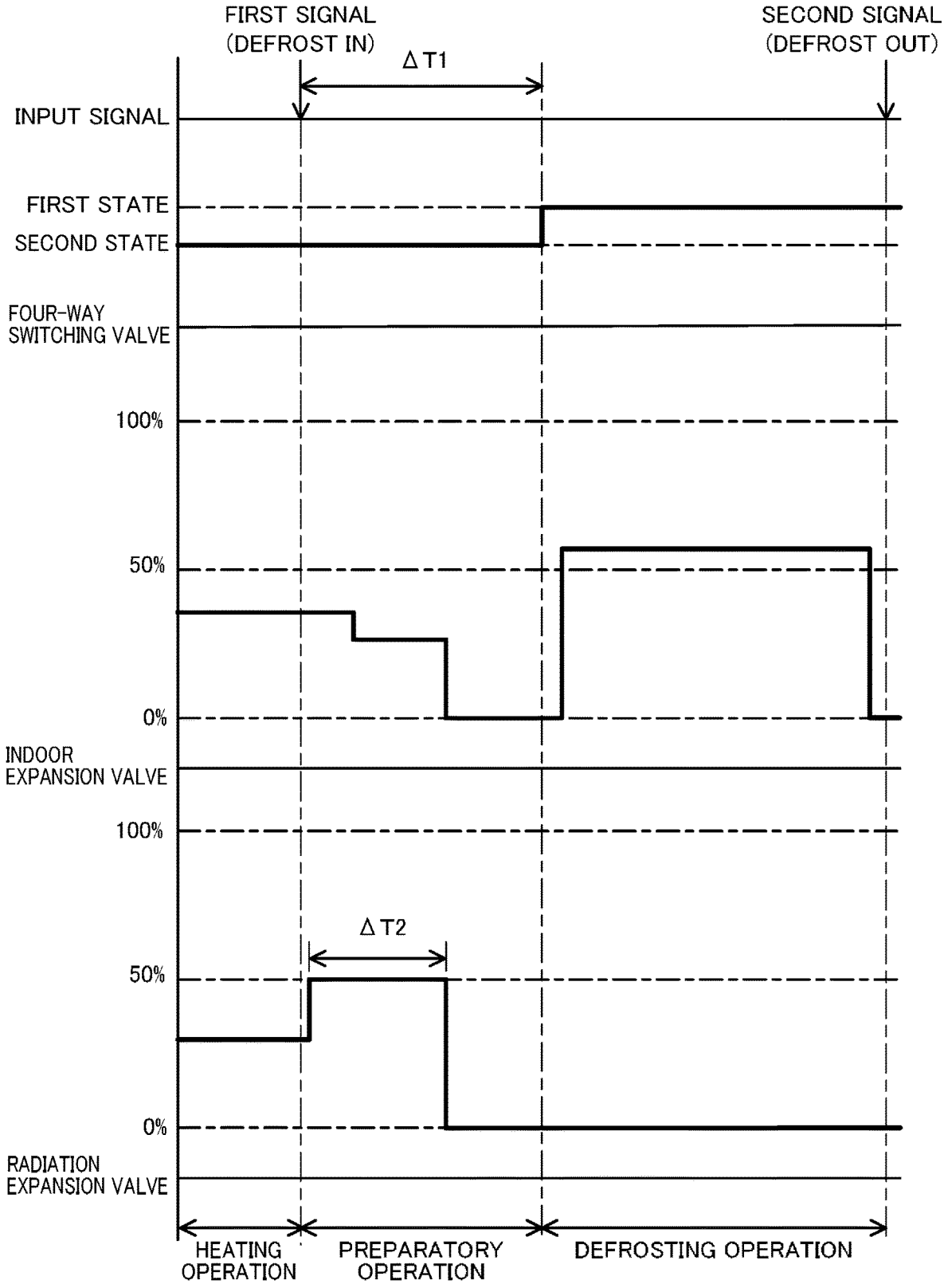
FIG. 3 is a timing chart illustrating how a four-way switching valve, an indoor expansion valve, and a radiation expansion valve are operated in a preparatory operation and a defrosting operation in one or more embodiments.

For example, when the above-described heating operation is performed, the surface of the outdoor heat exchanger (22) serving as an evaporator may be frosted. The air conditioner (10) is configured to be able to perform a defrosting operation for defrosting the outdoor heat exchanger (22). In the defrosting operation, the refrigerant dissipates heat and is condensed in the outdoor heat exchanger (22), and a refrigeration cycle (defrosting cycle) in which the refrigerant evaporates in the indoor heat exchanger (31) is performed. Further, the preparatory operation is executed before switching from the heating operation to the defrosting operation. In the preparatory operation of one or more embodiments, oil accumulated in the radiation panel (40) is discharged together with the liquid refrigerant. The preparatory operation and the defrosting operation will be described in detail with reference to FIGS. 1 and 3.

<Preparatory Operation>

For example, in the heating operation described above, if a condition A indicating that the surface of the outdoor heat exchanger (22) is frosted is satisfied, a first signal for executing the defrosting operation is inputted to each controller (C1, C2). Then, the preparatory operation for shifting from the heating operation to the defrosting operation starts. The preparatory operation is performed until a predetermined time ΔT1 elapses after the input of the first signal, and the operation is then shifted to the defrosting operation. Whether the condition A is satisfied or not is determined based on, for example, the temperature of the refrigerant flowing through the outdoor heat exchanger (22), the temperature of the air passing through the outdoor heat exchanger (22), and the duration of the heating operation.

In the preparatory operation, the number of rotations of the compressor (21) decreases stepwise. The compressor (21) stops operating before the defrosting operation starts. In a preparatory period, the opening degree of the indoor expansion valve (32) also decreases as the number of rotations of the compressor (21) decreases. The opening degree of the indoor expansion valve (32) may be controlled through the subcooling degree control, or through gradually reducing the target opening degree of the indoor expansion valve (32).

In the preparatory operation, the four-way switching valve (24) is kept unchanged from the state (the second state) during the heating operation. Therefore, the refrigerant flows basically in the same way as in the heating operation.

In the preparatory operation, the radiation controller (C2) brings the radiation expansion valve (51) to an open state at a predetermined opening degree (first opening degree) in synchronization with the first signal. Provided that the maximum opening degree of the radiation expansion valve (51) is 100% (e.g., about 2000 pulses), the first opening degree of one or more embodiments is set to an opening degree of 50% (e.g., about 1000 pulses).

When the radiation expansion valve (51) is forcibly opened during the preparatory period, the oil (refrigerating machine oil) can be reliably discharged from the radiation panel (40). This can avoid lubrication failure of the compressor (21) in the subsequent defrosting operation.

When time ΔT2 (e.g., 40 seconds) has elapsed after the change of the opening degree of the radiation expansion valve (51) to the first opening degree, the radiation expansion valve (51) is fully closed. Time ΔT2 is shorter than time ΔT1. Accordingly, the radiation expansion valve (51) is fully closed after the opening degree is changed to the first opening degree and before the defrosting operation starts. The opening degree corresponding to the "fully closed" state refers to an opening degree at which substantially no refrigerant flows inside the radiation panel (40), and is not necessarily limited to the opening degree of zero pulse.

<Defrosting Operation>

When time ΔT1 has elapsed after the start of the preparatory operation, the defrosting operation is performed. Then, the four-way switching valve (24) is switched from the second state to the first state. When the defrosting operation starts, the number of rotations of the compressor (21) gradually increases to a target number of rotations. Immediately after the start of the defrosting operation, the indoor expansion valve (32) is opened at a predetermined opening degree. For example, the indoor expansion valve (32) may be subjected to the superheat degree control, or the opening degree thereof may be regulated to a predetermined target opening degree. The outdoor expansion valve (23) is fully opened, for example.

In the defrosting operation, the radiation expansion valve (51) is controlled to be fully closed. In one or more embodiments, the radiation expansion valve (51) is fully closed immediately before the start of the defrosting operation. Thus, at the start of the defrosting operation, the target opening degree (e.g., zero pulse) of the radiation expansion valve (51) is kept unchanged. During the defrosting operation, the radiation expansion valve (51) is controlled to be always fully closed. Specifically, during the entire period of the defrosting operation, the target opening degree of the radiation expansion valve (51) is maintained at a value that keeps the fully closed state. Note that the target opening degree of the radiation expansion valve (51) may be changed to the value that keeps the fully closed state at the same timing as the start of the defrosting operation.

In the defrosting operation, the following refrigeration cycle (defrosting cycle) is basically performed. The refrigerant compressed in the compressor (21) flows through the outdoor heat exchanger (22). In the outdoor heat exchanger (22), the refrigerant dissipates heat to the frost on the surface of the outdoor heat exchanger (22). As a result, the frost on the outdoor heat exchanger (22) melts. The refrigerant that has dissipated heat and has been condensed in the outdoor heat exchanger (22) flows through the liquid connection pipe (17).

In the defrosting operation, the indoor expansion valve (32) is opened at a predetermined opening degree. Therefore, the refrigerant in the liquid connection pipe (17) is decompressed by the indoor expansion valve (32), and then evaporates in the indoor heat exchanger (31). The evaporated refrigerant flows through the gas connection pipe (16), and then is sucked into the compressor (21).

On the other hand, in the defrosting operation, the radiation expansion valve (51) is fully closed. Therefore, the refrigerant in the liquid connection pipe (17) is not sent to the radiation circuit (15) or the radiation panel (40) (the radiation heat exchanger (52)). If the refrigerant flows inside the radiation panel (40) in the defrosting operation, the refrigerant evaporates in the radiation panel (40). In this case, the surface temperature of the panel body (52) is lowered, thereby increasing a heating load of the indoor space. Further, a person in the room feels cold when he or she touches the panel body (52).

In contrast, in one or more embodiments, the radiation expansion valve (51) is fully closed during the entire period of the defrosting operation. Thus, the radiation panel (40) can be reliably avoided from being cooled due to the evaporation of the refrigerant. This can reliably avoid the heating load from increasing, or the comfort of the person in the room from being impaired.

As described above, the radiation expansion valve (51) is brought to the open state at the first opening degree in the preparatory operation. This allows the oil accumulated inside the radiation panel (40) to be discharged together with the refrigerant. Therefore, in the defrosting operation, a sufficient amount of oil can be maintained, thereby avoiding the lubrication failure of the compressor (21).

If a condition B indicating that the defrosting of the outdoor heat exchanger (22) is completed is satisfied during the defrosting operation, a second signal for ending the defrosting operation is inputted to each controller (C1, C2). Then, the defrosting operation is shifted to the normal operation (heating operation). Whether the condition B is satisfied or not is determined based on, for example, the temperature of the refrigerant flowing through the outdoor heat exchanger (22), the temperature of the air passing through the outdoor heat exchanger (22), and the duration of the defrosting operation.

Advantages of One or More Embodiments

According to the above embodiments, the radiation expansion valve (51) is always fully closed during the defrosting operation. This can reliably avoid the refrigerant from evaporating in the radiation panel (40).

The evaporation of the refrigerant in the indoor heat exchanger (31), which is present inside the indoor unit (30), does not have a great influence on the temperature of the indoor space. In particular, the influence on the indoor temperature is significantly reduced if the indoor fan (33) is stopped. In contrast, the radiation panel (40) is placed on the floor surface of the indoor space, and the panel body (52) is configured to be exposed to the indoor space. Thus, when the radiation panel (40) serves as an evaporator, the radiation tends to lower the temperature of the ambient air around the person in the room. Further, since the radiation panel (40) is within the reach of the person in the room, the person, if touches the radiation panel (40), may feel it cold and uncomfortable. In contrast, according to one or more embodiments, the ambient temperature of the radiation panel (40) can be reliably avoided from decreasing, and the person in the room from feeling uncomfortable.

According to the above-described embodiments, the radiation expansion valve (51) is brought to the open state at the first opening degree before the defrosting cycle starts. Specifically, receiving a signal (first signal) for executing the defrosting operation, the control unit (indoor controller (C1)) brings the radiation expansion valve (51) to the open state at the first opening degree before the defrosting operation starts. This allows the oil in the radiation panel (40) to be discharged and sent to the compressor (21). During the defrosting operation, the radiation expansion valve (51) is always fully closed, and thus, no refrigerant flows inside the radiation panel (40). However, since the oil is discharged from the radiation panel (40) as described above, the lubrication failure of the compressor (21) during the defrosting cycle can be avoided.

According to the above-described embodiments, the first opening degree is smaller than the maximum opening degree of the radiation expansion valve (51). If the opening degree of the radiation expansion valve (51) is too large, a larger amount of refrigerant flows through the radiation expansion valve (51), and the sound of the refrigerant passing through the valve may become noisy. Such noise can be reduced through making the opening degree of the radiation expansion valve (51) smaller than the maximum opening degree.

According to the above-described embodiments, the first opening degree is equal to or greater than 50% of the maximum opening degree of the radiation expansion valve (51). Thus, the oil can be reliably discharged from the radiation panel (40) during the preparatory period.

<<First Variation of One or More Embodiments>>

Figure 4:
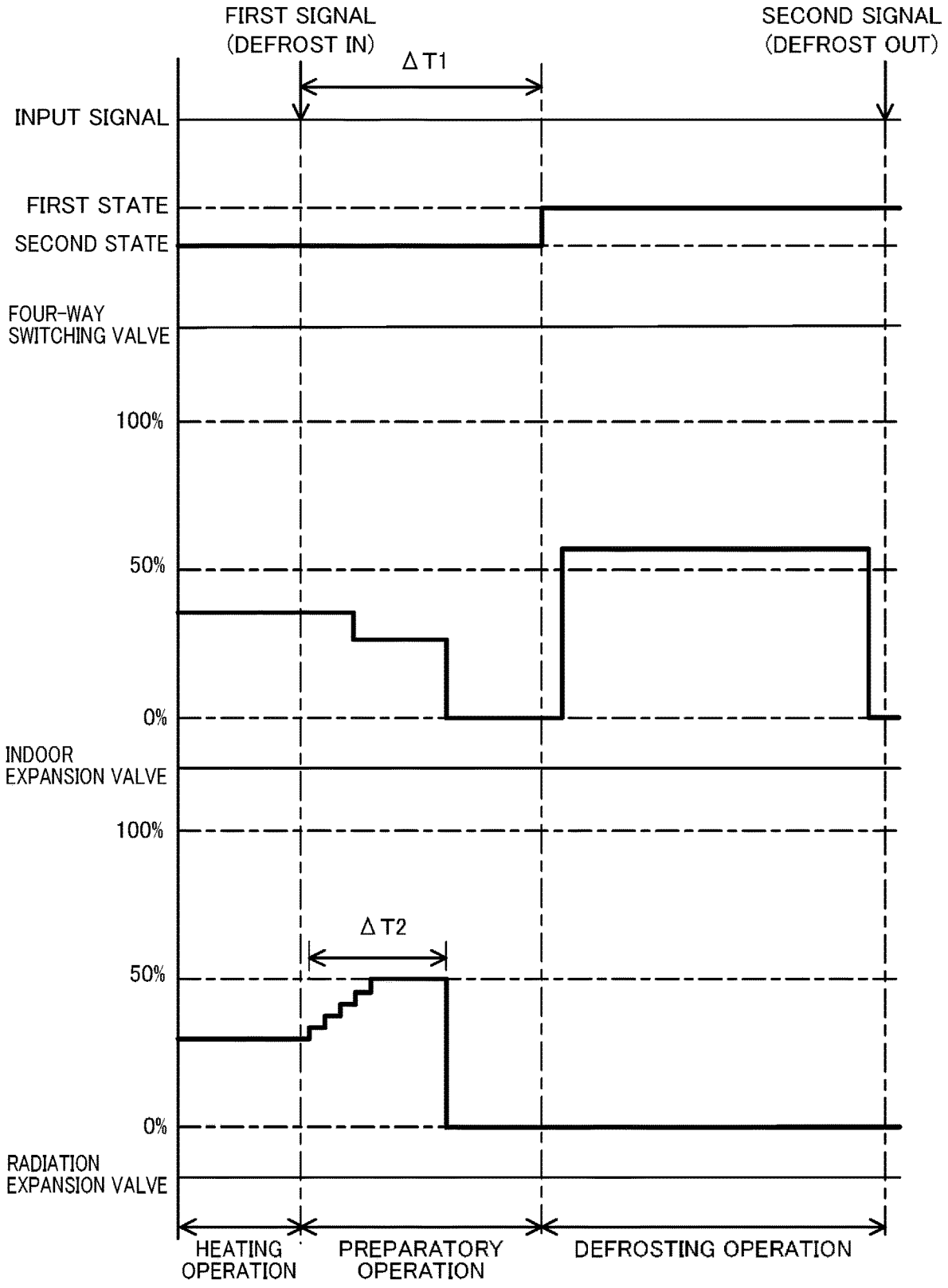
FIG. 4 is a view corresponding to FIG. 3, according to a first variation of one or more embodiments.

FIG. 4 illustrates a first variation of one or more embodiments, in which the control in the preparatory operation is different from that of the above embodiments. In the preparatory operation according to the first variation, the opening degree of the radiation expansion valve (51) is changed stepwise when the first signal is inputted. Specifically, receiving the first signal, the radiation controller (C2) changes the target opening degree of the radiation expansion valve (51) stepwise to be closer to a final target opening degree (first opening degree). As a result, the opening degree of the radiation expansion valve (51) gradually changes to converge to the first opening degree. Then, after time $\Delta T2$ has elapsed, the radiation expansion valve (51) is fully closed.

In the first variation, the opening degree of the radiation expansion valve (51) changes stepwise, which can keep the opening degree of the radiation expansion valve (51) from increasing abruptly. If the opening degree of the radiation expansion valve (51) abruptly increases, a large amount of liquid refrigerant passes through the radiation expansion valve (51), which may cause noise. On the other hand, if the radiation expansion valve (51) is gradually opened, the flow rate of the refrigerant that instantaneously flows through the radiation expansion valve (51) can be reduced. In addition, gradually increasing the opening degree of the radiation expansion valve (51) in this way makes it possible to gradually reduce the degree of subcooling of the refrigerant flowing through the radiation panel (40) in the preparatory operation, and the refrigerant can be brought into a gas-liquid two-phase state. This control can reduce the sound of the refrigerant passing through the radiation expansion valve (51). In the control of the radiation expansion valve (51), the opening degree of the radiation expansion valve (51) is suitably changed stepwise so that the refrigerant has a degree of subcooling of 5° C. or lower. Further, the target opening degree may be substantially changed in a linear fashion through shortening the period for which the target opening degree is changed stepwise.

<<Second Variation of One or More Embodiments>>

Figure 5:
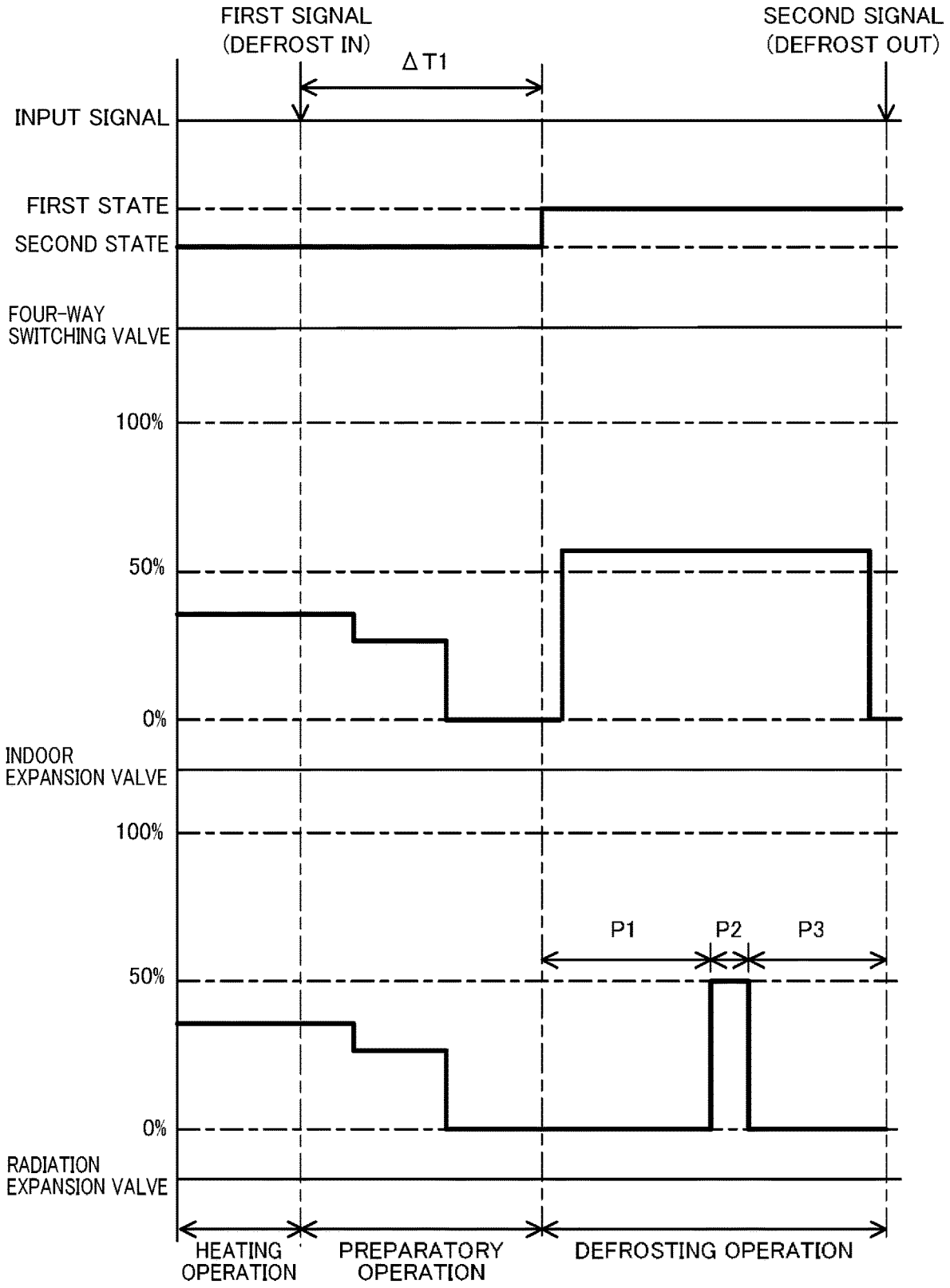
FIG. 5 is a view corresponding to FIG. 3, according to a second variation of one or more embodiments.

FIG. 5 illustrates a second variation of one or more embodiments, in which the control is different from that of the above embodiments.

<Preparatory Operation>

For example, in the heating operation described above, if a condition A indicating that the surface of the outdoor heat exchanger (22) is frosted is satisfied, a first signal for executing the defrosting operation is inputted to each controller (C1, C2). Then, the preparatory operation for shifting from the heating operation to the defrosting operation starts. The preparatory operation is performed until a predetermined time ΔT1 elapses after the input of the first signal, and the operation is then shifted to the defrosting operation. Whether the condition A is satisfied or not is determined based on, for example, the temperature of the refrigerant flowing through the outdoor heat exchanger (22), the temperature of the air passing through the outdoor heat exchanger (22), and the duration of the heating operation.

In the preparatory operation, the number of rotations of the compressor (21) decreases stepwise. The compressor (21) stops operating before the defrosting operation starts. In a preparatory period, the opening degree of the indoor expansion valve (32) also decreases as the number of rotations of the compressor (21) decreases. The opening degree of the indoor expansion valve (32) may be controlled through the subcooling degree control, or through gradually reducing the target opening degree of the indoor expansion valve (32).

In the preparatory operation, the four-way switching valve (24) is kept unchanged from the state (the second state) during the heating operation. Therefore, the refrigerant flows basically in the same way as in the heating operation.

In the preparatory operation, the radiation controller (C2) performs control of reducing the opening degree of the radiation expansion valve (51) with the decrease in the number of rotations of the compressor (21). The opening degree of the radiation expansion valve (51) may be controlled through the subcooling degree control, or through gradually reducing the target opening degree of the radiation expansion valve (51).

<Defrosting Operation>

When time ΔT1 has elapsed after the start of the preparatory operation, the defrosting operation is performed. Then, the four-way switching valve (24) is switched from the second state to the first state. When the defrosting operation starts, the number of rotations of the compressor (21) gradually increases to a target number of rotations. Immediately after the start of the defrosting operation, the indoor expansion valve (32) is opened at a predetermined opening degree. For example, the indoor expansion valve (32) may be subjected to the superheat degree control, or the opening degree thereof may be regulated to a predetermined target opening degree. The outdoor expansion valve (23) is fully opened, for example.

During the defrosting operation, the radiation controller (C2) temporarily opens the radiation expansion valve (51), and during the remaining period, the radiation controller (C2) brings the radiation expansion valve (51) to be fully closed. In one or more embodiments, the radiation expansion valve (51) is controlled to be fully closed in some periods (periods P1 and P3 in FIG. 3), and to be opened in the other period (period P2 in FIG. 3). The opening degree corresponding to the "fully closed" state refers to an opening degree at which substantially no refrigerant flows inside the radiation panel (40), and is not necessarily limited to the opening degree of zero pulse.

In the periods P1 and P3, the following refrigeration cycle (defrosting cycle) is basically performed. The refrigerant compressed in the compressor (21) flows through the outdoor heat exchanger (22). In the outdoor heat exchanger (22), the refrigerant dissipates heat to the frost on the surface of the outdoor heat exchanger (22). As a result, the frost on the outdoor heat exchanger (22) melts. The refrigerant that has dissipated heat and has been condensed in the outdoor heat exchanger (22) flows through the liquid connection pipe (17).

In the defrosting operation, the indoor expansion valve (32) is opened at a predetermined opening degree. Therefore, the refrigerant in the liquid connection pipe (17) is decompressed by the indoor expansion valve (32), and then evaporates in the indoor heat exchanger (31). The evaporated refrigerant flows through the gas connection pipe (16), and then is sucked into the compressor (21).

On the other hand, in the periods P1 and P3, the radiation expansion valve (51) is fully closed. Therefore, the refrigerant in the liquid connection pipe (17) is not sent to the radiation circuit (15) or the radiation panel (40) (the radiation heat exchanger (52)). If the refrigerant flows inside the radiation panel (40), the refrigerant evaporates in the radiation panel (40). In this case, the surface temperature of the panel body (52) is lowered, thereby increasing a heating load of the indoor space. Further, a person in the room feels cold when he or she touches the panel body (52).

In contrast, in the second variation, since the radiation expansion valve (51) is fully closed during the periods P1 and P3, the radiation panel (40) can be reliably avoided from being cooled due to the evaporation of the refrigerant. This can reliably avoid the heating load from increasing, or the comfort of the person in the room from being impaired.

On the other hand, if the radiation expansion valve (51) is fully closed for the entire period of the defrosting operation, oil (refrigerating machine oil) accumulates in the radiation expansion valve (51), which may result in a shortage of oil returning to the compressor (21). Thus, in the defrosting operation, the radiation expansion valve (51) is opened at a second opening degree for a certain period (period P2). Therefore, in the period P2, the oil accumulated in the radiation panel (40) can be discharged together with the refrigerant. As a result, in the defrosting operation, a sufficient amount of oil can be maintained, thereby avoiding the lubrication failure of the compressor (21).

Provided that the maximum opening degree of the radiation expansion valve (51) is 100% (e.g., about 2000 pulses), the second opening degree of one or more embodiments is set to an opening degree of 50% (e.g., about 1000 pulses). Setting the opening degree of the radiation expansion valve (51) to equal to or greater than 50% of the maximum opening degree allows the oil to be sufficiently discharged from the radiation panel (40).

If a condition B indicating that the defrosting of the outdoor heat exchanger (22) is completed is satisfied during the defrosting operation, a second signal for ending the defrosting operation is inputted to each controller (C1, C2). Then, the defrosting operation is shifted to the normal operation (heating operation). Whether the condition B is satisfied or not is determined based on, for example, the temperature of the refrigerant flowing through the outdoor heat exchanger (22), the temperature of the air passing through the outdoor heat exchanger (22), and the duration of the defrosting operation.

Advantages of Second Variation

According to the second variation, the radiation expansion valve (51) is fully closed in some periods (the periods P1 and P3) in the defrosting operation, and is opened in the other period (the period P2). Therefore, the evaporation of the refrigerant in the radiation panel (40) can be reliably avoided in the periods P1 and P3, and the oil can be reliably discharged from the radiation panel (40) in the period P2.

The evaporation of the refrigerant in the indoor heat exchanger (31), which is present inside the indoor unit (30), does not have a great influence on the temperature of the indoor space. In particular, the influence on the indoor temperature is significantly reduced if the indoor fan (33) is stopped. In contrast, the radiation panel (40) is placed on the floor surface of the indoor space, and the panel body (52) is configured to be exposed to the indoor space. Thus, when the radiation panel (40) serves as an evaporator, the radiation tends to lower the temperature of the ambient air around the person in the room. Further, since the radiation panel (40) is within the reach of the person in the room, the person, if touches the radiation panel (40), may feel it cold and uncomfortable. In contrast, according to the second variation, the ambient temperature of the radiation panel (40) can be reliably avoided from decreasing, and the person in the room from feeling uncomfortable, in the periods P1 and P3.

When the radiation expansion valve (51) is opened at the second opening degree in the period P2, the oil in the radiation panel (40) can be discharged and sent to the compressor (21). Thus, the lubrication failure of the compressor (21) during the defrosting cycle can be avoided.

According to the second variation, the second opening degree is smaller than the maximum opening degree of the radiation expansion valve (51). If the opening degree of the radiation expansion valve (51) is too large, a larger amount of refrigerant flows through the radiation expansion valve (51), and the sound of the refrigerant passing through the valve may become noisy. Such noise can be reduced through making the opening degree of the radiation expansion valve (51) smaller than the maximum opening degree.

According to the second variation, the second opening degree is equal to or greater than 50% of the maximum opening degree of the radiation expansion valve (51). Thus, the oil can be reliably discharged from the radiation panel (40).

<<Third Variation of One or More Embodiments>>

Figure 6:
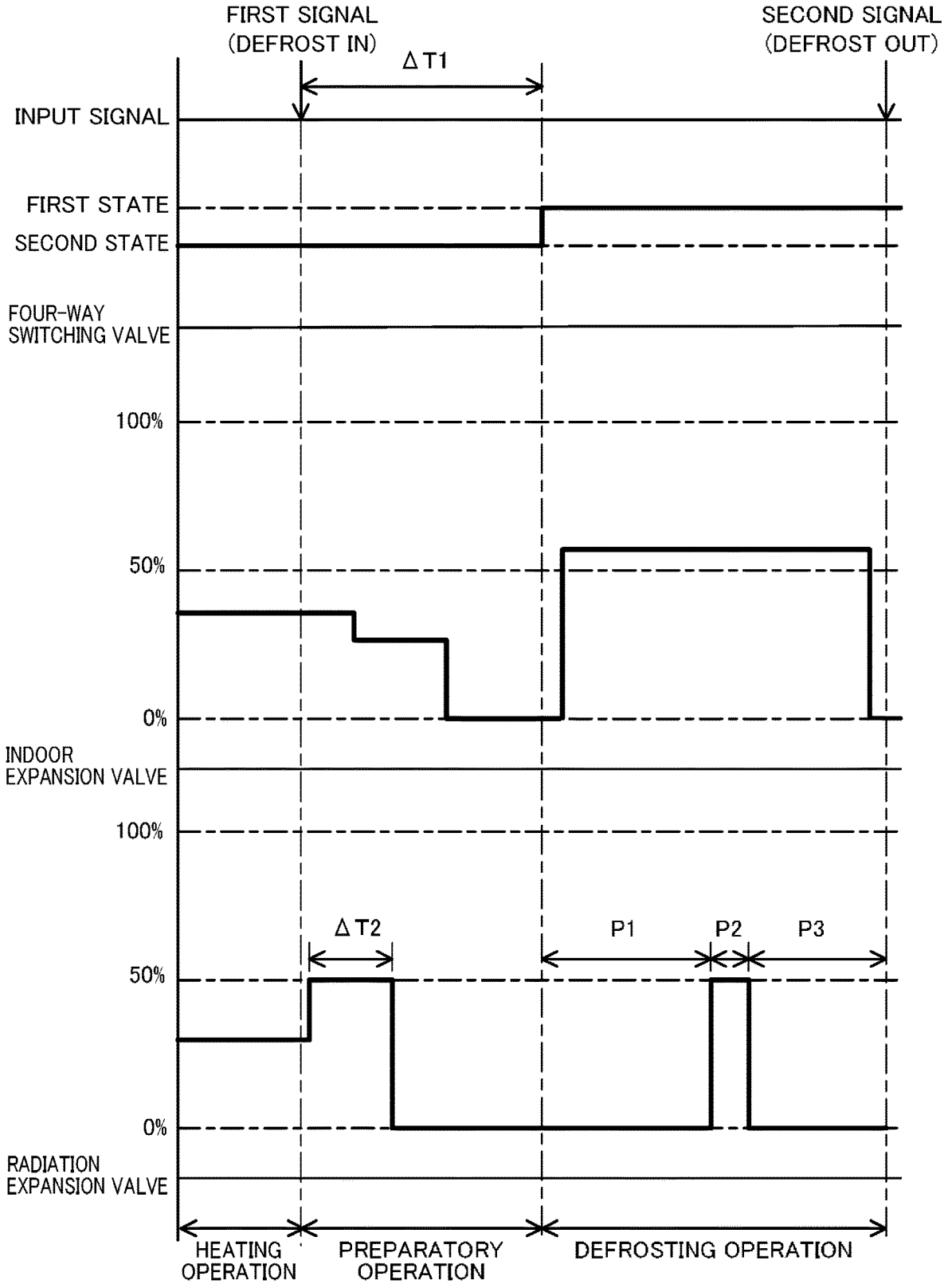
FIG. 6 is a view corresponding to FIG. 3, according to a third variation of one or more embodiments.

FIG. 6 illustrates a third variation of one or more embodiments, in which the control is different from that of the above embodiments.

In the preparatory operation, the radiation controller (C2) brings the radiation expansion valve (51) to the open state at a predetermined opening degree (first opening degree) in synchronization with the first signal. Provided that the maximum opening degree of the radiation expansion valve (51) is 100% (e.g., about 2000 pulses), the first opening degree according to the third variation is set to an opening degree of 50% (e.g., about 1000 pulses).

When the radiation expansion valve (51) is forcibly opened during the preparatory period, the oil (refrigerating machine oil) can be reliably discharged from the radiation panel (40). This can avoid lubrication failure of the compressor (21) in the subsequent defrosting operation.

When time ΔT2 has elapsed after the change of the opening degree of the radiation expansion valve (51) to the first opening degree, the radiation expansion valve (51) is fully closed. Time ΔT2 is shorter than time ΔT1. Accordingly, the radiation expansion valve (51) is fully closed after the opening degree is changed to the first opening degree and before the defrosting operation starts.

According to the third variation, the radiation expansion valve (51) is made open at the first opening degree before the defrosting cycle starts. This allows the oil in the radiation panel (40) to be discharged and sent to the compressor (21) before the defrosting operation. Thus, the lubrication failure of the compressor (21) during the defrosting cycle can be reliably avoided.

According to the third variation, the first opening degree is smaller than the maximum opening degree of the radiation expansion valve (51). If the opening degree of the radiation expansion valve (51) is too large, a larger amount of refrigerant flows through the radiation expansion valve (51), and the sound of the refrigerant passing through the valve may become noisy. Such noise can be reduced through making the opening degree of the radiation expansion valve (51) smaller than the maximum opening degree.

According to the third variation, the first opening degree is equal to or greater than 50% of the maximum opening degree of the radiation expansion valve (51). Thus, the oil can be reliably discharged from the radiation panel (40) during the preparatory period.

<<Fourth Variation of One or More Embodiments>>

Figure 7:
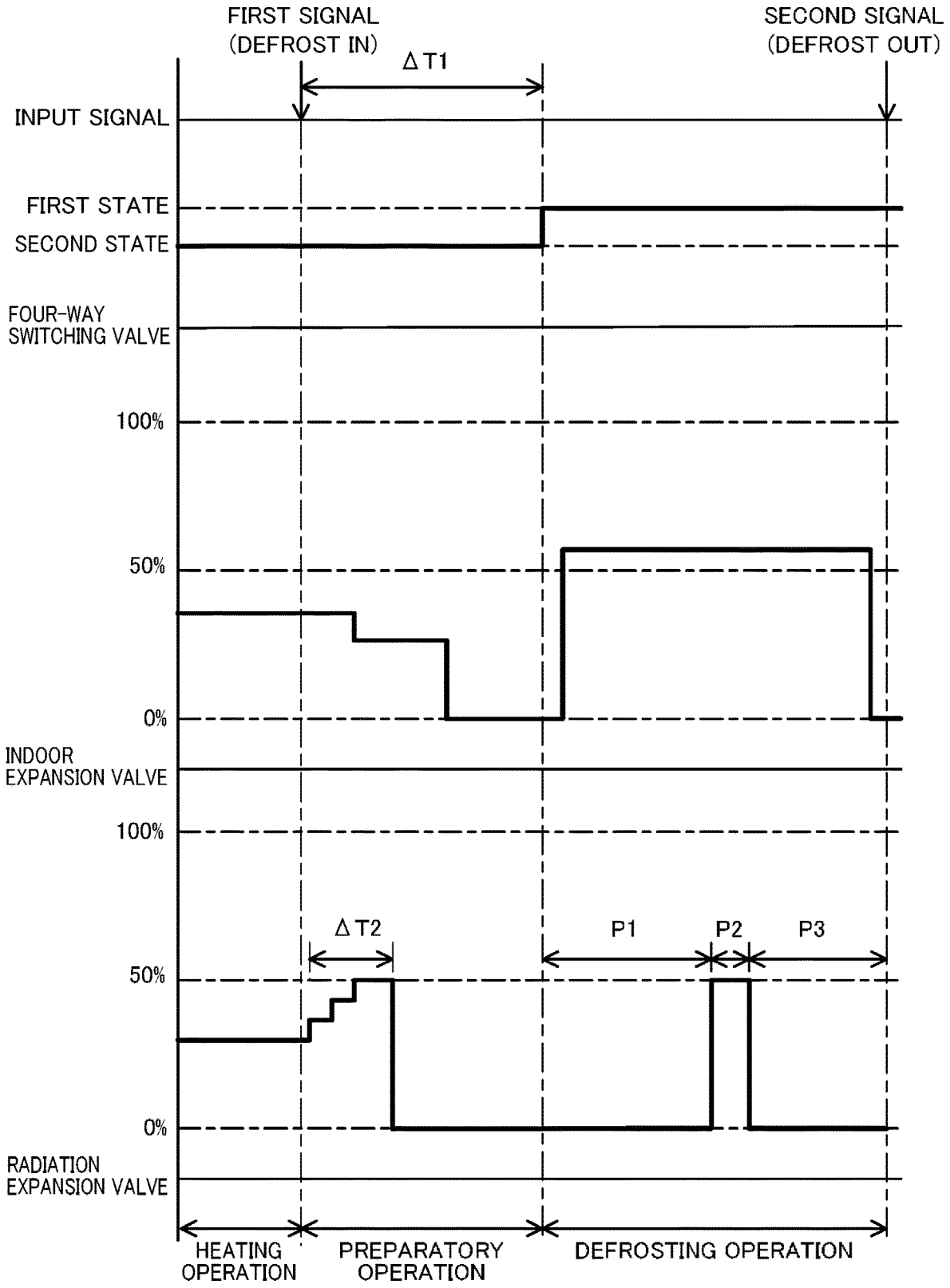
FIG. 7 is a view corresponding to FIG. 3, according to a fourth variation of one or more embodiments.

FIG. 7 illustrates a fourth variation of one or more embodiments, in which the control is different from that of the above embodiments. In the preparatory operation according to the fourth variation, the opening degree of the radiation expansion valve (51) is changed stepwise when the first signal is inputted. Specifically, receiving the first signal, the radiation controller (C2) changes the target opening degree of the radiation expansion valve (51) stepwise to be closer to a final target opening degree (first opening degree). As a result, the opening degree of the radiation expansion valve (51) gradually changes to converge to the first opening degree. Then, after time ΔT2 has elapsed, the radiation expansion valve (51) is fully closed.

In the fourth variation, the opening degree of the radiation expansion valve (51) changes stepwise, which can keep the opening degree of the radiation expansion valve (51) from increasing abruptly. If the opening degree of the radiation expansion valve (51) abruptly increases, a large amount of liquid refrigerant passes through the radiation expansion valve (51), which may cause noise. On the other hand, if the radiation expansion valve (51) is gradually opened, the flow rate of the refrigerant that instantaneously flows through the radiation expansion valve (51) can be reduced. In addition, gradually increasing the opening degree of the radiation expansion valve (51) in this way makes it possible to gradually reduce the degree of subcooling of the refrigerant flowing through the radiation panel (40) in the preparatory operation, and the refrigerant can be brought into a gas-liquid two-phase state. This control can reduce the sound of the refrigerant passing through the radiation expansion valve (51). In the control of the radiation expansion valve (51), the opening degree of the radiation expansion valve (51) is suitably changed stepwise so that the refrigerant has a degree of subcooling of 5° C. or lower. Further, the target opening degree may be substantially changed in a linear fashion through shortening the period for which the target opening degree is changed stepwise.

<<Fifth Variation of One or More Embodiments>>

Figure 8:
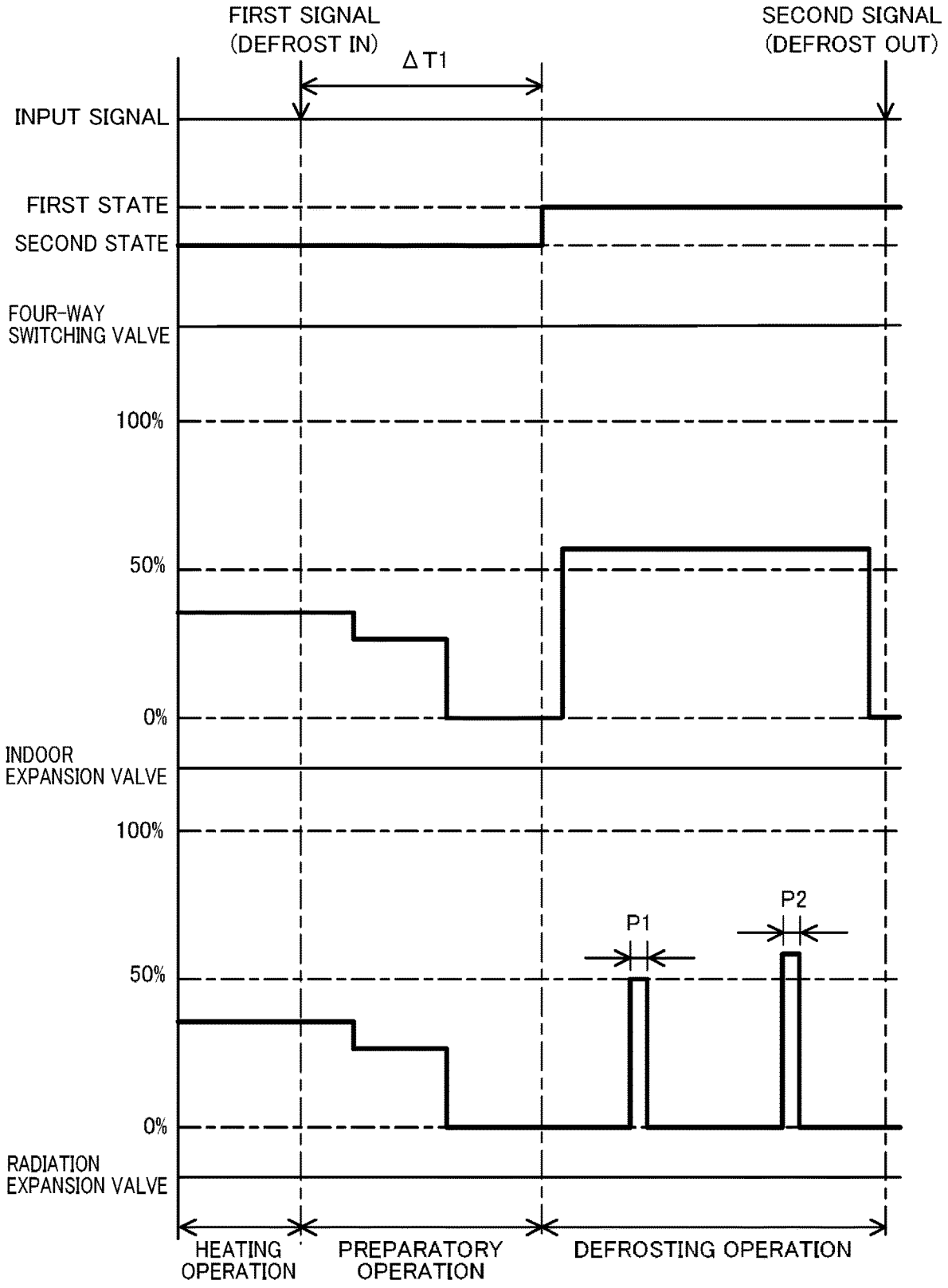
FIG. 8 is a view corresponding to FIG. 3, according to a fifth variation of one or more embodiments.

In a fifth variation of one or more embodiments shown in FIG. 8, the radiation expansion valve (51) is opened in some periods (two periods P2 and P4 in this variation) in the defrosting operation. For example, in the period P2, the radiation expansion valve (51) is opened at a second opening degree (e.g., 50% of the maximum opening degree). For example, in the period P4, the radiation expansion valve (51) is opened at an opening degree greater than the second opening degree. As described above, in the defrosting operation, the radiation expansion valve (51) may be opened at the first opening degree in a certain period, and at an opening degree different from the first opening angle in a different period.

Other Embodiments

The air conditioner (10) of the above-described embodiments performs the heating operation in which all of the indoor heat exchanger (31) and the radiation panel (40) serve as radiators, and the cooling operation in which all of the indoor heat exchanger (31) and the radiation panel (40) serve as evaporators. However, the air conditioner (10) may be configured as a system (a so-called simultaneous cooling/heating system) that performs the cooling and heating operations simultaneously by using one of the indoor heat exchanger (31) or the radiation panel (40) as an evaporator, and the other as a condenser. In this case, the number of the connection pipes may be two or three.

The air conditioner (10) may be configured as a system in which the radiation panel (40) (strictly speaking, the radiation heat exchanger (52)) and the indoor heat exchanger (31)) are housed in a single unit (e.g., a floor type unit).

The air conditioner (10) may have no indoor heat exchanger (31), and may include a heat exchanger (first heat exchanger) dedicated to the defrosting operation. For example, in the cooling operation, a refrigeration cycle is performed in which the outdoor heat exchanger (22) serves as a radiator, and the radiation panel (40) as an evaporator. In the heating operation, a refrigeration cycle is performed in which the radiation panel (40) serves as a radiator, and the outdoor heat exchanger (22) as an evaporator. Further, in the defrosting operation, a refrigeration cycle (defrosting cycle) is performed in which the outdoor heat exchanger (22) (first heat exchanger) serves as a radiator, and the heat exchanger (second heat exchanger) dedicated to the defrosting operation as an evaporator.

The indoor unit (30), which is mounted on the ceiling (strictly speaking, hung from or embedded in the ceiling), may be replaced with an indoor unit placed on the floor surface or mounted on a wall surface.

The radiation panel (40), which is placed on the floor surface, may be replaced with a radiation panel mounted on the ceiling or the wall surface.

INDUSTRIAL APPLICABILITY

As can be seen in the foregoing, one or more embodiments of the present invention are useful for an air conditioner.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

DESCRIPTION OF REFERENCE CHARACTERS

10 Air Conditioner
11 Refrigerant Circuit
20 Outdoor Unit
22 Outdoor Heat Exchanger (First Heat Exchanger)
30 Indoor Unit
31 Indoor Heat Exchanger (Second Heat Exchanger)
40 Radiation Panel
51 Radiation Expansion Valve (Expansion Valve)

The invention claimed is:

1. An air conditioner that switches between a normal refrigeration cycle and a defrosting refrigeration cycle, the air conditioner comprising:

a refrigerant circuit that connects a first heat exchanger, a second heat exchanger, a radiation panel that performs air conditioning in an indoor space of a room, and an expansion valve that regulates a flow rate of a refrigerant flowing through the radiation panel; and a controller that causes the air conditioner to switch between the normal refrigeration cycle and the defrosting cycle, wherein during the normal refrigeration cycle, the radiation panel performs cooling or heating, during the defrosting cycle, the first heat exchanger serves as a radiator and the second heat exchanger serves as an evaporator, during the defrosting cycle, the controller causes the expansion valve to be in a fully closed state, and while the air conditioner is in a preparatory period of shifting from the normal refrigeration cycle to the defrosting cycle, the controller causes the expansion valve to be in an open state at a first opening degree.

2. The air conditioner of claim 1, wherein during the defrosting cycle, the controller keeps the expansion valve in the fully closed state.

3. The air conditioner of claim 1, wherein the first opening degree is smaller than a maximum opening degree of the expansion valve.

4. The air conditioner of claim 3, wherein the first opening degree is equal to or greater than 50% of the maximum opening degree of the expansion valve.

5. The air conditioner of claim 1, wherein before the defrosting cycle starts, the controller changes an opening degree of the expansion valve stepwise to the first opening degree.

6. The air conditioner of claim 1, wherein the first heat exchanger is disposed in an outdoor unit, and the second heat exchanger is disposed in an indoor unit.

7. The air conditioner of claim 3, wherein before the defrosting cycle starts, the controller changes an opening degree of the expansion valve stepwise to the first opening degree.

8. The air conditioner of claim 2, wherein the first heat exchanger is disposed in an outdoor unit, and the second heat exchanger is disposed in an indoor unit.

9. The air conditioner of claim 3, wherein the first heat exchanger is disposed in an outdoor unit, and the second heat exchanger is disposed in an indoor unit.

10. The air conditioner of claim 4, wherein the first heat exchanger is disposed in an outdoor unit, and the second heat exchanger is disposed in an indoor unit.

11. The air conditioner of claim 5, wherein the first heat exchanger is disposed in an outdoor unit, and the second heat exchanger is disposed in an indoor unit.

* * * * *